United States Patent [19]

Altmann et al.

[11] 4,318,542

[45] Mar. 9, 1982

[54] SORTER MECHANISM

[75] Inventors: Conrad Altmann; Edgar M. Feathers, both of Rochester, N.Y.

[73] Assignee: Eastman Kodak Company, Rochester, N.Y.

[21] Appl. No.: 70,295

[22] Filed: Aug. 28, 1979

Related U.S. Application Data

[63] Continuation of Ser. No. 435,910, Jan. 23, 1974, abandoned.

[51] Int. Cl.[3] ..... B65H 29/54

[52] U.S. Cl. ..... 271/290; 271/186; 271/291; 271/297; 271/305

[58] Field of Search ..... 271/279, 287, 290, 291, 271/294, 295, 297, 305, 197, 186, 187

[56] References Cited

U.S. PATENT DOCUMENTS 2,589,676 3/1952 Crissy ..... 271/295 X 2,876,008 3/1959 Mestre ..... 271/295

FOREIGN PATENT DOCUMENTS 1436096 1/1969 Fed. Rep. of Germany ..... 271/295

*Primary Examiner*—Richard A. Schacher

*Attorney, Agent, or Firm*—Lawrence P. Kessler

[57] ABSTRACT

A sorter mechanism for receiving and stacking discrete sheets in a preselected order. A plurality of bins are provided for receiving discrete sheets delivered to the bins with a given side facing in a particular orientation. The bins, each of which have oppositely disposed first and second sheet supporting members, are positionable so as to support the sheets with the given side facing the first sheet supporting members when the bins are in a first position and with the given side facing the second sheet supporting members when the bins are in the second position. Sheets fed along a predetermined path to the sorter mechanism are directed into selective bins, the bins being selectively positioned in either of the mentioned positions dependent upon the original orientation of the given sheet side in the predetermined path and the desired final order of the sheets being stacked.

12 Claims, 6 Drawing Figures

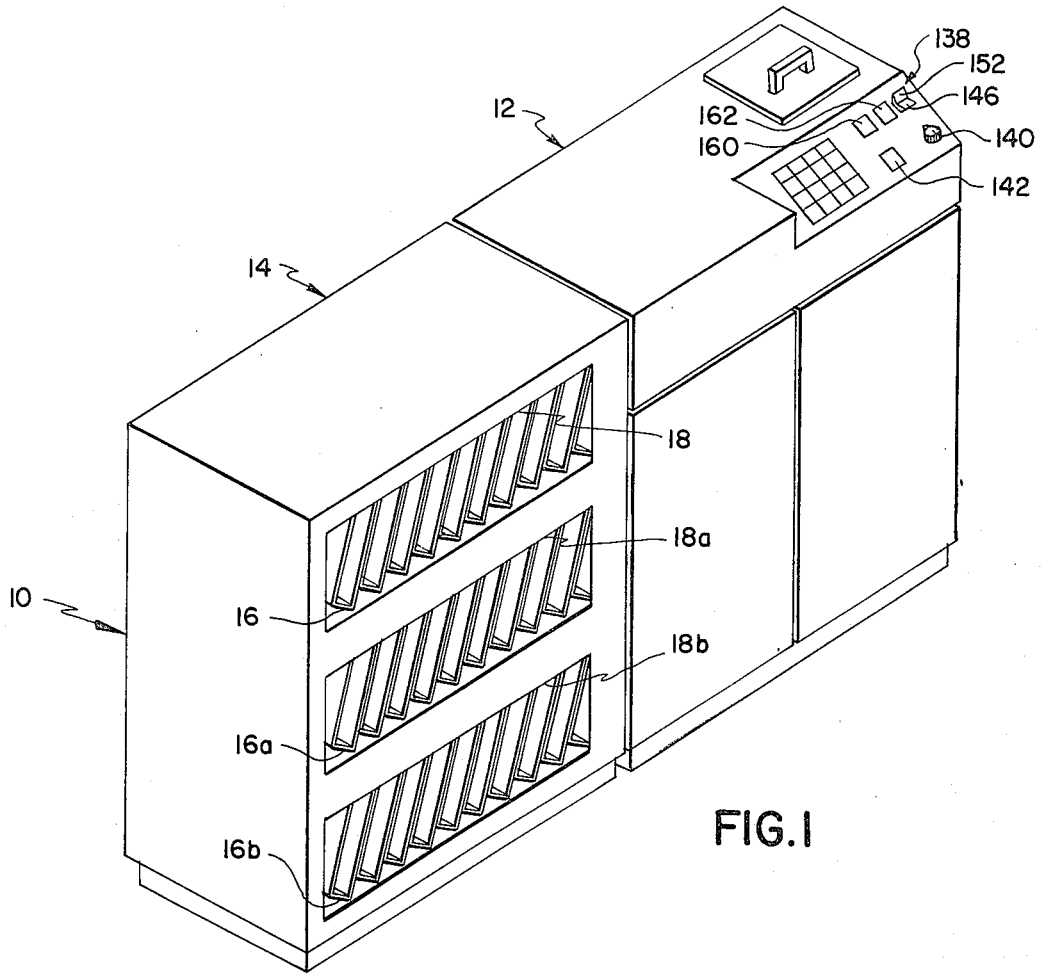
FIG.1
FIG.6
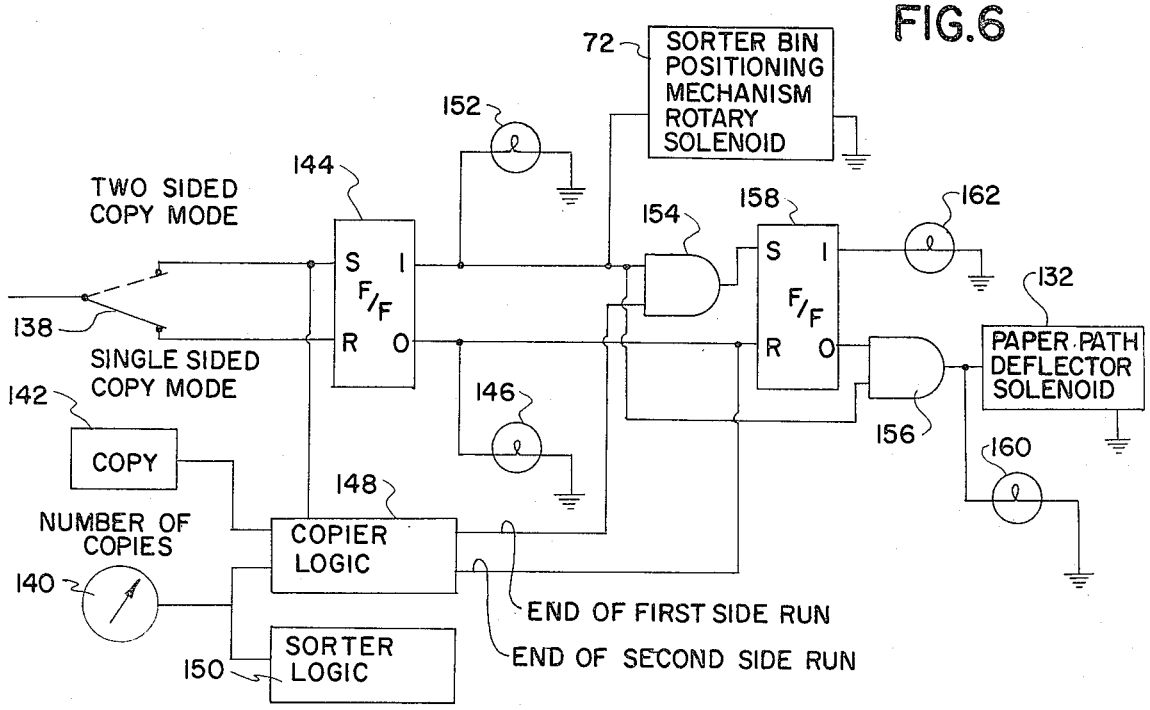

SORTER MECHANISM

This is a continuation of application Ser. No. 435,910, filed Jan. 23, 1974 and now abandoned.

BACKGROUND OF THE INVENTION

1. Field of the Invention

This invention relates to sorter mechanisms and more particularly mechanisms for sorting discrete sheets and stacking the sheets in a preselected order.

2. Description of the Prior Art

The advance in technology concerning copying and duplicating machines has resulted in their widespread and increasing use for most office copying needs. Multiple copies of a single document are now turned out rapidly with high quality. However, when making a number of copies from a multipage document, the document must be disassembled, multiple copies made of each sheet, the multiple copies must be collated to form a completed copy of the original, and the original document must be reassembled. This may involve considerable clerical time and effort which places a limit on the overall efficiency of the copy machine itself.

In order to increase the efficiency of office copiers and aid them in reaching their full potential, sorter mechanisms have been developed which automatically perform the former clerical step of stacking and collating the multiple copies. However, when the copier machine has the capability of accomplishing both one-sided and two-sided copying, collating has heretofore been possible with only one copy format. The complicating aspect involved in stacking and collating sheets from a copier capable of both copy formats is that in one-sided copying the copy receiver sheet exits the copier in one orientation (e.g. copy side face-down) while in two-sided copying the copy receiving sheet exits the copier in the opposite orientation (e.g. first copy side face-up). Thus, if the sorter mechanism is set to properly stack sheets copied in one format in a preselected order (e.g. numerical order), sheets copied in the other format will not be stacked in the same desired order.

SUMMARY OF THE INVENTION

It is therefore a primary object of this invention to provide a sorter mechanism which is capable of receiving and stacking discrete sheets in a desired preselected order regardless of the facial orientation of the received sheet as delivered to the mechanism.

It is a further object of this invention to provide a sorter mechanism which may receive and stack, in proper numerical order, sheets that have copied information on either one side or both sides of the sheet.

Accordingly there is herein provided a sorter mechanism having a plurality of bins located adjacent a predetermined discrete sheet travel path, the sheets traveling with a given side in a particular facial orientation. The bins, each of which have oppositely disposed first and second sheet supporting members, are movable between a first position to receive and support sheets with the given side facing the first sheet supporting members, and a second position to receive and support the sheets with the given side facing the second sheet supporting members. Sheets fed along the travel path are diverted into selective bins, the bins being positioned in either of the mentioned positions dependent upon the original facial orientation of the given sheet side in the predetermined travel path and the final order of the sheets being stacked.

BRIEF DESCRIPTION OF THE DRAWINGS

FIG. 1 is a perspective view of a typical office copier and a sorter mechanism according to this invention showing the relative positioning therebetween;

FIG. 6 is a schematic view of the logic arrangement for interrelating the functions of the copier with the functions of the sorter mechanism.

DESCRIPTION OF THE PREFERRED EMBODIMENTS

Figure 2:
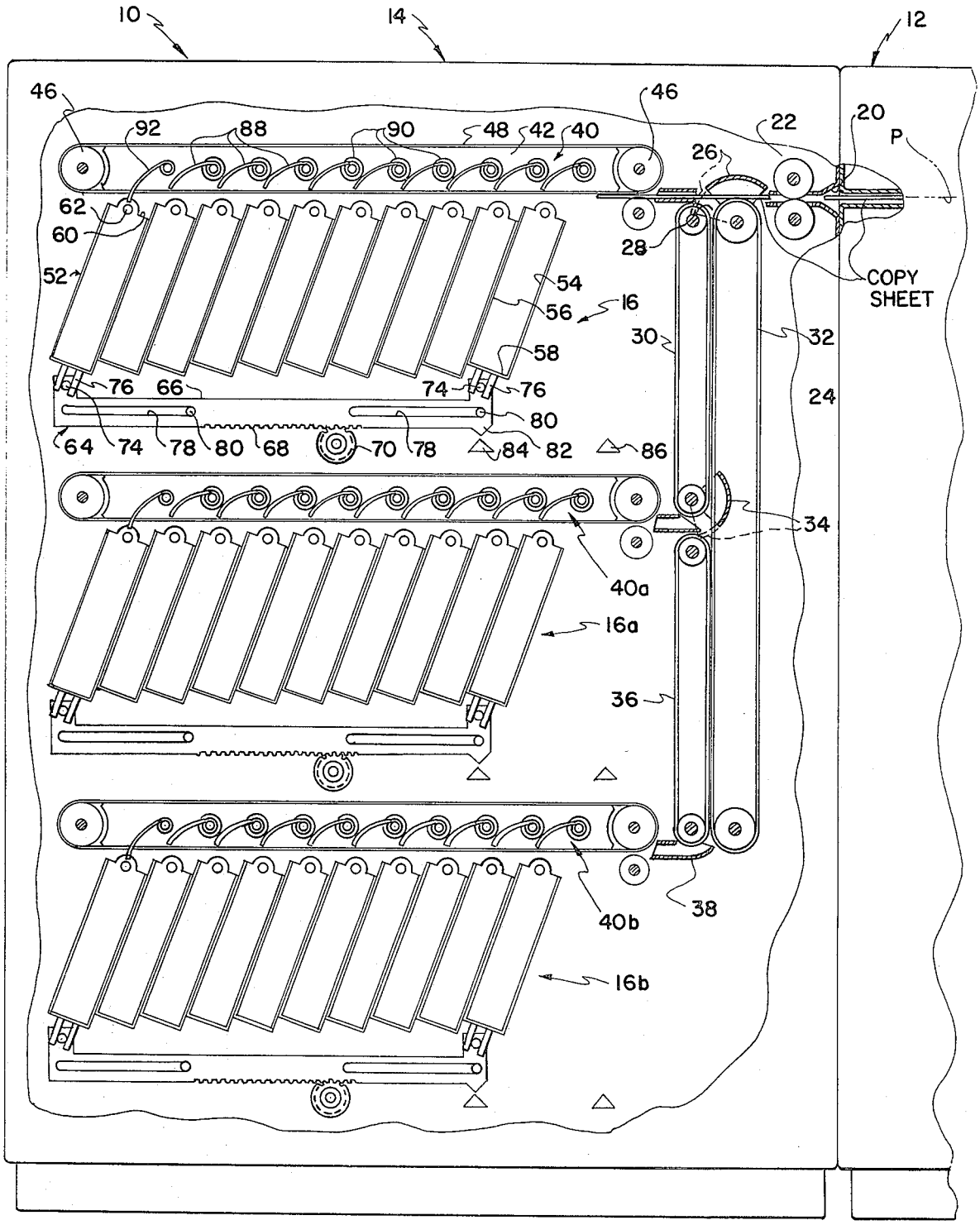
FIG. 2 is a side elevational view, in section, of a sorter mechanism according to this invention.

Referring now to the drawings, FIGS. 1 and 2 show a sorter mechanism 10 positioned relative to a typical office copier 12 to stack and collate discrete copy sheets received therefrom. The copier 12 is of the type capable of making copies in either a single-side or two-sided copy mode (as for example in the manner to be explained hereinbelow). The sorter mechanism 10 has a frame 14 within which is located a series of bin assemblies 16, **16*a* and 16*b* for receiving copy sheets. The frame 14 has openings 18, 18*a* and 18*b* in one side wall to provide ready access to the bin assemblies to remove sheets stacked in respective bins. As will, of course, become apparent the particular number of bins or bin assemblies is not critical to this invention and is only dependent upon the maximum number of stacks of copies desired. In the embodiment shown, thirty bins have been provided but this number could be increased by including a tandem arrangement of units substantially identical to the mechanism 10, or decreased by eliminating the bin assemblies 16*a*, 16*b* and covering their respective openings 18*a*, 18*b***.

In order to rceive discrete copy sheets from the copier 12 and deliver them to the bin assemblies for collating and stacking, the frame 14 has an entrance throat 20 located such that when the sorter mechanism 10 is positioned relative to the copier 12 as shown in FIG. 1, the entrance throat 20 is immediately adjacent the exit path from the copier 12. The throat 20 has a set of feed rollers 22 which positively feed the received discrete copy sheets to respective transport mechanisms for the various bin assemblies. Bin assembly 16 will receive the sheets directly from the throat 20, while bin assemblies **16*a* and 16*b* receive the sheets via a transport mechanism 24. The transport mechanism 24 includes a movable first deflector 26, which in the full-line position of FIG. 2 permits a copy sheet received at the throat 20 to be fed directly to the bin assembly 16. When the deflector 26 is moved to its broken-line position, a copy sheet being fed by the rollers 22 will be deflected into the nip 28 of a pair of cooperating transport belts 30, 32** which define a sheet transport path.

Located adjacent the bin assembly **16*a*, is a movable second deflector 34, which in its broken-line position (FIG. 2) directs sheets being transported by the belts 30, 32 to the bin assembly 16***a*. In its full-line position, the deflector 34 permits a sheet being transported between belts 30 and 32 to be directed into a transport path defined by belt 32 and a belt 36 (similar to belt 30). The cooperating belts 32 and 36 will transport a copy sheet toward a third deflector 38. The deflector 38 is stationary in order that all sheets striking the deflector will be directed toward bin assembly 16*b*.

Figure 3:
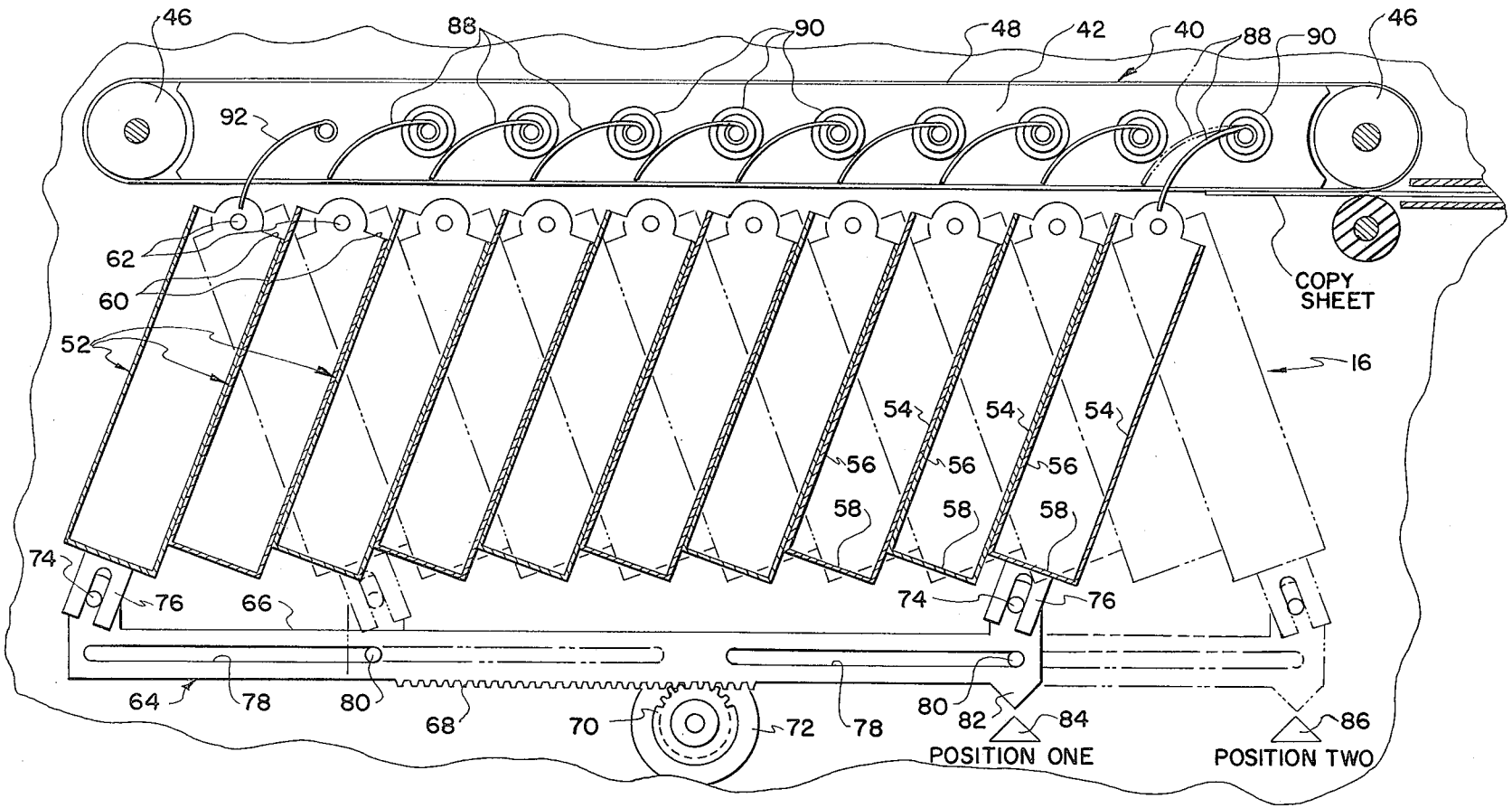
FIG. 3 is an enlarged side elevational view, in section, of one bin assembly of the sorter mechanism of this invention.
Figure 4:
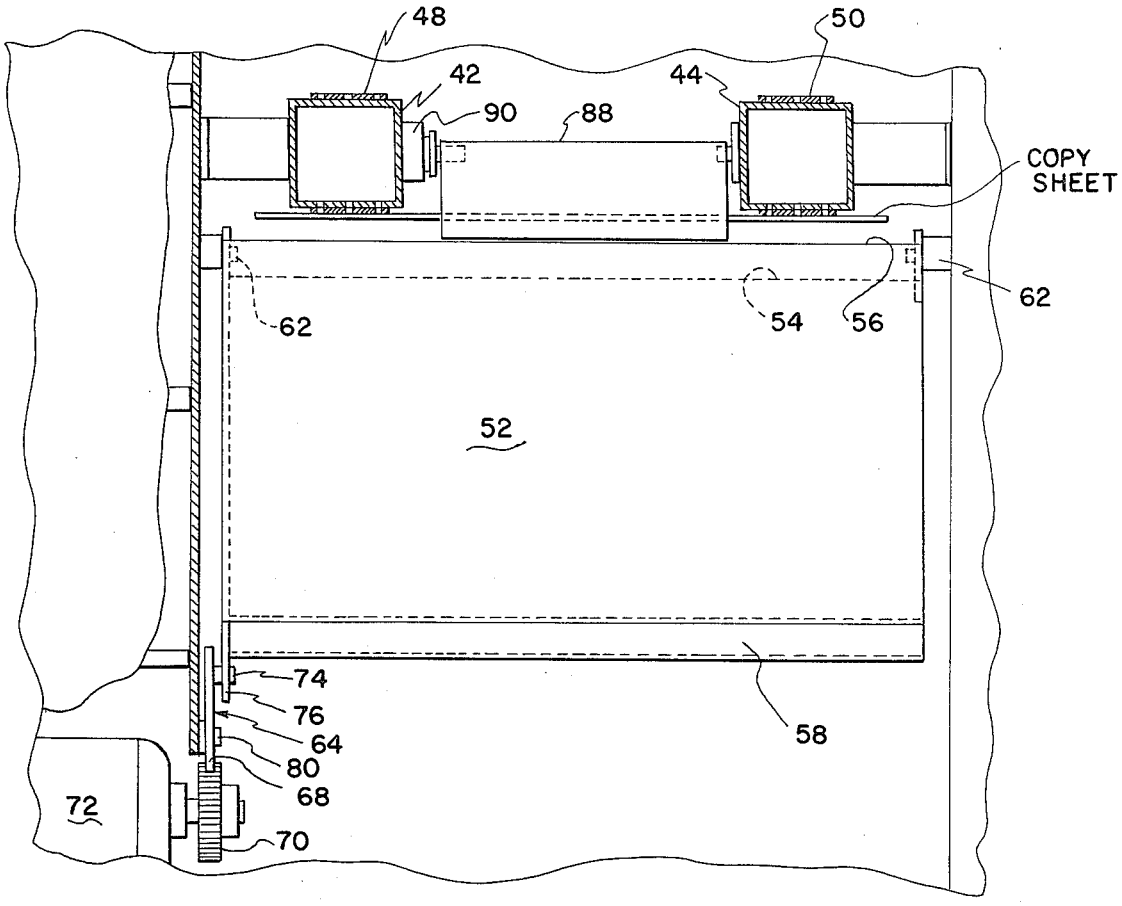
FIG. 4 is a typical transverse sectional view of the bin assembly of the sorter mechanism shown in FIG. 3.

In the interest of simplicity, bin assembly 16 will now be described in detail with particular reference to FIGS. 3 and 4, it being understood that each of the bin assemblies are of identical construction. Bin assembly 16 has a transport arrangement 40 for delivering the discrete copy sheets to the vicinity of individual bins in the assembly 16. The transport arrangement 40 has a pair of spaced-apart vacuum chambers 42, 44 (FIG. 4). Pairs of drive rollers 46 positioned adjacent the ends of each chamber support transport belts 48, 50. The rollers 46 cause the belts to track in closed loop paths, the belts being positioned so that the path of each belt intimately traverses its respective vacuum chamber. The belts 48, 50 have a series of openings which cooperate with a series of openings in the lower surface of the vacuum chambers such that the belts will support and transport a received copy sheet along a predetermined path.

Located directly beneath the transport arrangement 40 is a series of sheet receiving bins 52. Each bin is comprised of a first wall 54 and a second wall 56 which, in cooperation with an interconnecting end wall 58, respectively form first and second sheet supporting members. The end 60 of the bin 52 opposite the end wall 58 is open so as to permit the entrance of discrete copy sheets into the interior of the bin. Each bin 52 is supported for pivotal movement by pins 62, the pivoting action being controlled by a bin assembly positioning mechanism 64. The bins are spaced apart at such a distance that adjacent walls (56, 54) are in intimate contact at the extreme positions of the bins.

The positioning mechanism 64 is comprised of a slide 66 having a gear rack 68 integral therewith. A gear 70 mounted on the shaft of a rotary solenoid 72 meshes with the rack 68. Actuation of the solenoid will cause rotation of the gear 70 to control the position of the slide 66. The slide 66 has a set of pins 74, one located at each end thereof. The pins 74 cooperate with yoke-like members 76 extending from the first and last of the bins 52 to transmit motion of the slide 66 to the bins 52. The slide 66 has a pair of slots 78 through which pins 80, fixed to the frame 14, extend to form a pin-in-slot guide to limit the movement of the slide. The slide 66 also has an indicating pointer 82 which aligns with a first position indicator 84 when the bin assembly 16 is in a first position (full-line position of FIG. 3) and a second position indicator 86 when the bin assembly is in a second position (broken-line position of FIG. 3). Movement of the bin positioning mechanism to move the bins 52 from the first position to the second position is accomplished by rotation of the gear 70. Rotation of the gear 70 will impart longitudinal movement to the slide 66 which in turn will cause the bins 52 to rotate about the respective pivot pins 62, by interaction of the pins 74 and yoke-like members 76, as the slide moves from the full-line position of FIG. 3 to the broken-line position of FIG. 3.

In order to deflect the copy sheets into respective receiving bins 52, a series of deflecting vanes 88 located between the vacuum chambers 48, 50 (see FIG. 4) is provided. The vanes are located such that each bin has a respective vane immediately thereabove in a relation thereto such that a sheet deflected by the particular vane will be directed into the respective bin irrespective of the position of the bin. Independent rotary solenoids 90 are associated with each vane 88 to provide independent control of the position of the respective vane from a position out of the path of the copy sheet established by the transport arrangement 40 to a position to intercept the path to redirect a discrete copy sheet traveling along the path toward a preselected bin where it will fall under the influence of gravity. It should be noted that in order to prevent jamming in the mechanism 10, the final deflecting vane 92 has a permanently fixed position so that no copy sheet will ever proceed beyond the last of the series of sheet receiving bins in any of the bin assemblies. In an alternative arrangement (not shown) the sheets may be redirected by a single vane intercepting the transport path established by the transport arrangement 40, the single vane being movable to overlie each of the bins in a desired sequence.

As noted above, the sorter mechanism 10 according to this invention, in the preferred embodiment, is particularly adaptable to collating copy sheets produced by an office copier capable of making one-sided or two-sided copies. Sorting in either copier mode of operation is possible because the ultimate order of the stacked copy sheets is made dependent upon its initial facial orientation (when in the transport arrangement established path) and upon the position of the sheet receiving bins. That is to say that knowing the original orientation of the copy sheet in the transport arrangement established path, the position of the bins 52 may be selected so that the copy sheets stacked and collated in the bins will be in a preselected order. A copier 12 capable of dual copy format operation (forming no part of this invention) is shown schematically in FIG. 5 and is described only to the extent necessary for a complete understanding of the interrelation between the copier 12 and the sorter mechanism 10.

A document D to be copied is placed on a platen 94 with a lateral edge against the registration edge R where it is positioned to be illuminated by flash lamps 96. An image of the illuminated document is exposed on a photoconductor web 98 by means of a lens 100 and mirrors 102, 104. The photoconductor web 98 is mounted for movement on support rollers 106, and during operation of the copier 12 is constantly moved in the direction of the arrow 108. The web 98, which receives an electrostatic charge as it passes through a charging station 110, has the charge thereon altered by flash exposure of the image of the document D onto the photoconductor web at the exposure station 112 to form a latent image pattern. The latent image charge pattern is developed by application of charge-attracted particles to the exposed area of the web 98 in a developing station 114. The particles which form the developed image are subsequently transferred to the face-down side of an appropriate copy receiver sheet at a transfer station 116. The receiver sheet onto which the image is copied is transported along a path through the transfer station 116 by means of drive rollers 118, 120. The sheet is fed selectively from a receiver sheet supply stack, located in either a first supply hopper 122 or a second supply hopper 124, by sheet feeders 126 or 128 associated respectively with the hoppers 122 and 124. Downstream of the transfer station 116 is a deflector 130 which is selectively positionable by a solenoid 132 to move the deflector 130 into an intercepting relationship with respect to the path P (broken-line position of FIG. 5) from its position out of the path P (full-line position of FIG. 5). A cooperating belt transport arrangement 134 receives any copy sheet deflected by the deflector 130 to return it to the second supply hopper 124 (to enable the copier to make two-sided copies as described hereinbelow). Timing of the various operational steps is accomplished by a logic arrangement such as that described in U.S. Pat. No. 3,914,047 issued Oct. 25, 1975 to Hunt et al.

Figure 5:
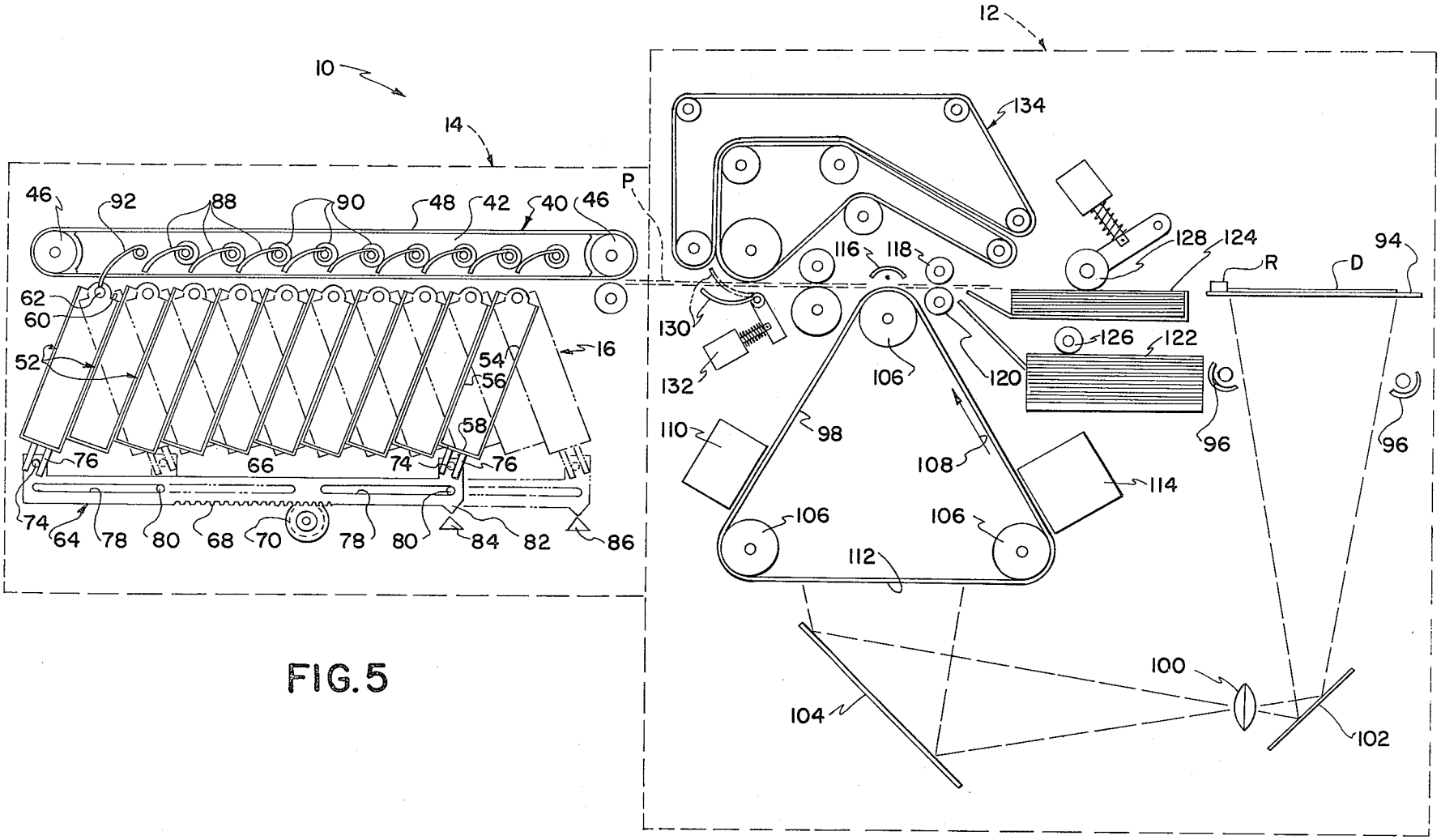
FIG. 5 is a side elevational view, in section, showing in schematic form a typical office copier capable of two-sided copying and one bin assembly of the sorter mechanism according to this invention with the necessary interrelation therebetween.

The operation of the sorter mechanism 10 in conjunction with the copier 12 is described as follows with particular reference to FIGS. 5 and 6. Before starting the copy sequence, the machine operator determines whether a multipage document to be copied has printing on both sides of each page or only on one side. If only one side of each page is to be copied, the first page is placed on the platen 94 with the print side face down and one lateral edge against the registration edge R. A mode selection switch 138 is moved to its "single-sided copy mode" position and a copy number selector 140 is set for the desired number of copies. When the mode selection switch 138 is set in the "single-sided copy mode" position, the flip flop 144 will be placed in its reset state so as to provide a signal for lamp 146 to give visual indication that the copier 12 is in the single-sided copy mode. The setting of the copy number selector 140 will arm the copier logic (designated in FIG. 6 as logic 148) and the sorter logic 150 so that the necessary functions of each will be accomplished in the correct timed sequence.

The "copy" button 142 may then be activated and the copier 12 will proceed to make the required number of copies (each copy being made in the manner described above) with the copies being individually transported, copy side face down, along path P and thence into the sorter mechanism 10. The sorter logic 150 controls the sorter mechanism 10 such that each succeeding copy sheet will be deposited sequentially into the bins 52 of the bin assembly 16 by selective actuation of the deflector vanes 88. If the number of copies to be made exceeds the number of bins in assembly 16, the sorter logic 150 will, at the proper time, move deflectors 26 and 34 (FIG. 2) to their appropriate positions so that the sheets will be directed into bin assembly 16*a* and thereafter, if necessary, into bin assembly 16*b*. The bins 52 are in their first position (full-line position of FIG. 5) so that a copy sheet entering a specific bin will be directed, under the influence of gravity, against the first wall 54. Thus, when the bins are in the first position, the copy side of the receiver sheet will be directed toward the wall 54. When the desired number of copies of the first page have been made, the second page of the multipage document may be placed on the platen 94 with a lateral edge against the registration edge R and the procedure repeated. As each succeeding page is copied, the receiver sheets will be directed to enter the bins 52 facing in a similar direction so that when the entire multipage document has been copied, each bin will contain a collated copy thereof with the pages stacked in the proper sequential order.

If it is determined that the multipage document has printing on both sides of each page, then this fact must be communicated to the copier logic 148 so as to enable the copier 12 to function in its "two-sided copy mode". In order to accomplish this end, the mode selection switch 138 is moved to its "two-sided copy mode" position. This action will provide both an appropriate input signal for the copier logic 148 and a signal to change the state of the flip-flop 144, the flip-flop 144, in turn, providing a signal for lamp 152 to give a visual indication that the copier is in the two-sided copy mode. The signal from the flip-flop 144 will, in addition, actuate the rotary solenoid 72 to move the sorter bin assembly 16 to its second position and provide input signals for AND gates 154 and 156. Since AND gate 156 is also receiving an input signal from the flip-flop 158 (which is in its reset state), the AND gate 156 will assume a positive condition to provide a signal for the lamp 160 and the paper path deflector solenoid 132. The lamp 160 will give a visual indication that the first side of the document is to be copied while the paper path deflector solenoid 132 will move the paper path deflector 130 into its broken-line position (FIG. 5) to intercept path P in order to direct copy sheets traveling along path P to the second sheet hopper 124 (which at the start of the copy run must be clear of receiver sheets) via the transport arrangement 134.

The copy number selector 140 is set for the desired number of copies to appropriately arm the copier logic 148 and sorter logic 150 and the first page of the multipage document is placed on the platen 94 with its numerically first side face down and a lateral edge against the registration edge R. The "copy" button 142 may then be activated and the copier 12 will proceed to make the required number of copies, each of the copies being redirected in turn by the deflector 130 and transport arrangement 134 to the hopper 124 as noted above. The configuration of the transport arrangement 134 inverts the copy sheets, which are received from the path P in a face down orientation, so that the sheets will be stacked in the hopper 124 with the copy side of the sheet face-up.

When the desired number of copies of the first side of the document have been made, the copier logic will send an "end of first side run" input signal to the AND gate 154, thus providing the gate with the two necessary input signals for it to assume a positive condition. In the positive condition, AND gate 154 will provide a signal to set the flip-flop 158. In the set state, the flip-flop 158 will provide a signal for the lamp 162 to give a visual indication that the apparatus is ready to copy the second side of the document. With the change in state of the flip-flop 158, an input signal will no longer be provided by the flip-flop to the AND gate 156. Therefore, the gate will return to its non-positive condition eliminating the signal to the lamp 160 and the paper path deflector solenoid 132. Thus the lamp 160 will be extinguished and the paper path deflector 130 will return to its full-line position, out of the copy sheet travel path P.

The numerically second side of the first page of the document is then placed face down on the platen 94 with a lateral edge against the registration edge R and the copy button 142 is activated. The copier 12 will proceed to make copies of the second side of the document on the back side of the sheets which received the copy of the first side. This is accomplished by using the copy sheets in the second hopper 124 as receiver sheets for the second copy side; that is to say, the sheets on which the first side was copied are fed to the transfer station 116 from the second hopper 124 at the proper timed interval. Since the sheets are stacked in the hopper with the first copied side face up, the sheets will be in the proper orientation at the transfer station to receive the copy of the second side of the original document.

After the image of the second side is transferred to the copy sheets, the sheets will be transported (with the first copied side still being oriented face-up) along the path P past the deflector 130, which is maintained out of the path, and into the throat 20 of the sorter mechanism 10. The logic 150 of the sorter mechanism will selectively actuate the deflectors 88 to sequentially deposit each copy sheet into the individual bins 52 of the assembly 16 (or asemblies 16*a*, 16*b* depending on the number of copies desired). With the bins in their second position, the copy sheets, under the influence of gravity, will be directed toward the second side 56 of each respective bin. Thus the sheets will be stacked in the bin so that the first copied side is face-down. When the desired number of copies have been made, an "end of second side run" signal will be sent to flip-flop 158 to place it in the reset state. The reset of the flip-flop 158 will extinguish the signal to the lamp 162 and re-establish the positive condition of the AND gate 156 to turn on the lamp 160 and reactivate the paper path deflector solenoid 132. The copier 12 will then be ready to copy the numerically first side of the second page of the multipage document.

The above procedure is repeated with each page of the original document until the entire document is copied. As noted, because of the position of the bins, the completed copies of each page of the document, transported to the sorter mechanism 10 with the first copied side face-up, are collated and stacked in the mechanism 10 with the first-copied side directed face-down toward the second end walls 56 of respective bins 52. Thus, when the copying of the document is complete, each bin 52 will contain a complete copy of the document stacked and collated in such a manner that the pages thereof are in proper sequential order.

From the foregoing it is apparent that there is herein provided a sorter mechanism capable of stacking and collating discrete sheets in a preselected desired order regardless of whether copies are one-sided or two-sided. While the invention has been described in detail with particular reference to the preferred embodiment, it will be understood that variations and modifications can be effected within the spirit and scope of the claims.

We claim:

1. Apparatus for receiving and stacking a series of discrete sheets traveling, with a similar facial orientation, along a path leading to such apparatus, said apparatus comprising:

a sheet receiving bin for receiving sheets from said path and for supporting such received sheets in either of two facial orientations, said bin being mounted for movement relative to said path into first or second sheet receiving positions, said bin including a first sheet supporting member effective when said bin is in said first position to support sheets received from said path with a facial orientation similar to the facial orientation of such sheets in said path, and a second sheet supporting member effective when said bin is in said second position to support sheets received from said path with a different facial orientation relative to the facial orientation of such sheets in said path; and means for selectively moving said bin into said first or second positions.

2. The invention of claim 1, wherein said first member includes a first sheet supporting surface and said second member includes a second sheet supporting surface substantially parallel to said first surface when said bin is in its first or second position, said bin being mounted for pivotal movement such that said first and second surfaces are sloped in one direction relative to vertical when said bin is in said first position and in the opposite direction relative to vertical when said bin is in said second position, whereby gravity urges such received sheets toward said first surface when said bin is in said first position and toward said second surface when said bin is in said second position.

3. A sorter mechanism for collating and stacking, in a desired order, discrete sheets traveling along a path leading to such mechanism, a given face of successive sheets having the same facial orientation in said path, said sorter mechanism comprising:

a plurality of sheet receiving bins positioned adjacent to said path for receiving sheets from said path and for supporting such received sheets in either of two facial orientations, each of said bins having a first sheet supporting surface and a second sheet supporting surface, said bins having a first sheet receiving position relative to said path wherein said first surface supports discrete sheets directed into the bins from said path in an orientation similar to their facial orientation in said path, and a second sheet receiving position relative to said path wherein said second surface supports discrete sheets directed into the bins from said path in an orientation different from their facial orientation in said path, means for directing discrete sheets traveling along said path into said bins, and means for selectively moving said bins into either said first or second positions to produce a stack of sheets having a desired facial orientation and a desired order.

4. The invention of claim 3, wherein said bins are mounted for pivotal movement such that the first and second surfaces are sloped in one direction relative to vertical when the bins are in said first position and in the opposite direction relative to vertical when the bins are in said second position, whereby gravity urges such sheets toward said first surfaces when the bins are in said first position and toward said second surfaces when the bins are in said second position.

5. For use in conjunction with apparatus for selectively making single-sided or two-sided copies on receiver sheets and transporting such sheets along a path with the copy side in one orientation for single-sided copies and the first copy side in the opposite orientation for two-sided copies, a sorter located adjacent to said path for receiving and stacking such sheets in collated order, said sorter comprising:

a plurality of sheet receiving bins, each of said bins including a first sheet supporting member and a second sheet supporting member spaced therefrom for receiving sheets therebetween, said bins being mounted for movement relative to said path selectively into first or second positions, said positions being such that when said bins are in said first position, said first sheet supporting members support single-sided receiver sheets with the copy side in a particular orientation with respect to said first sheet supporting members, and when said bins are in said second position, said second sheet supporting members support two-sided receiver sheets with the first copy side in a particular orientation with respect to said second sheet supporting members, each of said particular orientations assuring that receiver sheets stacked in said bins are in collated order; means for moving said bins to said first position when single-sided copies are being transported along said path, or to said second position when two-sided copies are being transported along said path, and means for directing receiver sheets from said path into said bins.

6. The invention of claim 5, wherein each of said first members include a first sheet supporting surface and each of said second members include a second sheet supporting surface substantially parallel to said first surface when said bins are in said first or second positions, said bins being mounted for pivotal movement such that the said first and second surfaces are sloped in one direction relative to vertical when said bins are in said first position and in the opposite direction relative to vertical when said bins are in said second position, whereby gravity urges such sheets toward said first surfaces when said bins are in said first position and toward said second surfaces when said bins are in said second position.

7. The invention of claim 5, wherein said means for directing receiver sheets from said path includes means for intercepting sheets traveling in said path to direct such sheets into said bins, and means for selectively positioning said intercepting means in said path to direct such sheets into any selected one of said bins.

8. For use in conjunction with apparatus for selectively making single-sided or two-sided copies on receiver sheets and transporting sheets along a path with the copy side in one orientation for single-sided copies and the first copy side in the opposite orientation for two-sided copies, a sorter located adjacent to said path for receiving and stacking said sheets in collated order, said sorter comprising:

a sheet receiving bin, said bin including a first sheet supporting member and a second sheet supporting member spaced therefrom for receiving sheets therebetween, said bin being mounted for movement relative to said path into first or second positions, wherein when said bin is in said first position, said first sheet supporting member supports single-sided receiver sheets with the copy side in a particular orientation with respect to said first sheet supporting member, and wherein when said bin is in said second position, said second sheet supporting member supports two-sided receiver sheets with the first copy side in a particular orientation with respect to said second sheet supporting member, each of said paticular orientations assuring that said sheets stacked in said bin are in collated order; means for moving said bin to said first position when single-sided copies are being transported along said path or to said second position when two-sided copies are being transported along such path; and means for directing said receiver sheets from said path into said bin.

9. A mechanism for receiving and stacking in a desired order, a series of discrete sheets traveling, with a similar facial orientation, along a path leading to such mechanism, said mechanism comprising:

a sheet receiving bin for receiving sheets from said path and for supporting such received sheets in either of two facial orientations, said bin including a first sheet supporting member supporting sheets received from said path in a first facial orientation, and a second sheet supporting member supporting sheets received from said path in a second facial orientation different from said first facial orientation; and means for selectively directing sheets from said path into the interior of said bin on to either said first or second sheet supporting member to produce a sheet stack in a desired order.

10. Apparatus for collating and stacking, in a desired order, discrete sheets traveling along a path with a similar facial orientation, said apparatus comprising:

a plurality of sheet receiving bins positioned adjacent to said path, each of said bins including a first sheet supporting member and a second sheet supporting member substantially parallel to said first sheet supporting member, said bins being mounted for movement into a first position relative to said path wherein said first sheet supporting members support discrete sheets directed into respective bins in a first facial orientation relative to their facial orientation in said path, or a second position relative to said path wherein said second sheet supporting members support discrete sheets directed into respective bins in a different facial orientation relative to their facial orientation in said path;

means for sequentially directing discrete sheets traveling along said path into said bins, said directing means including a plurality of deflector vanes having a first position out of said path and being selectively movable from said first position to a second position in said path to intercept sheets in said path, said plurality of vanes being associated with said plurality of bins respectively whereby discrete sheets can be directed sequentially into selected bins; and means for selectively moving said bins into said first or second positions, whereby discrete sheets directed into said bins are stacked in either said first facial orientation or said different facial orientation respectively to produce a collated sheet stack in said desired order.

11. For use in conjunction with an apparatus for selectively making single-sided or two-sided copies on receiver sheets and transporting such sheets along a path with the copy side in one facial orientation for single-sided copies and the first copy side in the opposite facial orientation for two-sided copies, a sorter located adjacent to said path for receiving and stacking such sheets in collated order, said sorter comprising:

a plurality of sheet receiving bins, each of said bins including a first sheet supporting member and a second sheet supporting member spaced therefrom for receiving receiver sheets therebetween, said bins being selectively movable relative to said path into first or second positions, wherein when said bins are in said first position, said first sheet supporting members support single-sided receiver sheets with the copy side in a particular orientation with respect to said first sheet supporting members, and wherein when said bins are in said second position said second sheet supporting members support two-sided receiver sheets with the first copy side in a particular orientation with respect to said second sheet supporting members, each of said particular orientations assuring that said sheets stacked in said bins are in collated order; means for moving such bins to said first position when single-sided copies are being transported along said path, or to said second position when two-sided copies are being transported along said path; and means for directing receiver sheets from said path into said bins, said directing means including a plurality of movable deflecting vanes positioned adjacent to said path opposite said plurality of bins respectively, and means for selectively moving said vanes into said path for intercepting sheets traveling in said path to direct such sheets into said respective bins.

12. Sheet receiving apparatus for receiving sheets traveling along a path leading to such apparatus from a reproducing machine, said apparatus comprising:

at least one sheet receiving bin, said bin being arranged generally vertically, said bin including first and second side members extending generally parallel to one another for supporting a sheet in said bin;

means for pivotally supporting said side members for movement between a first orientation wherein said side members are generally inclined from vertical in one direction and a sheet in said bin is supported by said first side member, and a second and different orientation wherein said side members are generally inclined from vertical in the opposite direction and a sheet in said bin is supported by said second side member;

means for selectively positioning said side members in said first orientation or in said second orientation; and means for conveying sheets from said path to said bin when said side members are positioned in either of said first or second orientations.

* * * * *